United States Patent [19]

Yamaguchi

[11] 4,098,106

[45] Jul. 4, 1978

[54] BENDING METHOD AND APPARATUS WITH SLIDABLE CLAMP

[75] Inventor: Jousuke Yamaguchi, Kanagawa, Japan

[73] Assignee: Daiichi Koshuha Kogyo Kabushiki Kaisha, Tokyo, Japan

[21] Appl. No.: 709,950

[22] Filed: Jul. 29, 1976

Related U.S. Application Data

[62] Division of Ser. No. 593,961, Jul. 8, 1975, Pat. No. 4,062,216.

[51] Int. Cl.[2] ..... B21D 7/03; B21D 7/16

[52] U.S. Cl. ..... 72/128; 72/369

[58] Field of Search ..... 72/128, 149, 151, 156, 72/159, 310, 342, 364, 369

[56] References Cited

U.S. PATENT DOCUMENTS

| | | | |
|---|---|---|---|
| 785,083 | 3/1905 | Brinkman | 72/128 |
| 1,601,405 | 9/1926 | Michaelsen | 72/156 |
| 2,286,893 | 6/1942 | Boissou | 72/369 |
| 3,368,377 | 2/1968 | Hirayama et al. | 72/128 |
| 3,896,649 | 7/1975 | Stuart | 72/128 |
| 3,902,344 | 9/1975 | Stuart | 72/128 |

FOREIGN PATENT DOCUMENTS

| | | | |
|---|---|---|---|
| 1,527,333 | 6/1973 | Fed. Rep. of Germany | 72/156 |
| 525,895 | 9/1940 | United Kingdom | 72/157 |

*Primary Examiner*—E. M. Combs

*Attorney, Agent, or Firm*—Burns, Doane, Swecker & Mathis

[57] ABSTRACT

A pipe bending apparatus includes a pivotable bending arm carrying a means for engaging the pipe including an outer clamp attached to the arm and an inner clamp contacting the pipe and slidable within the outer clamp.

6 Claims, 6 Drawing Figures

BENDING METHOD AND APPARATUS WITH SLIDABLE CLAMP

RELATED APPLICATION

This is a divisional application of pending prior application Ser. No. 593,961 filed on July 8, 1975, now U.S. Pat. No. 4,062,216.

BACKGROUND OF THE INVENTION

There are known two general methods for accomplishing bending work on metal pipes, rods, or the like. In cold bending, the desired bending work is performed by giving to the work piece a bending moment that exceeds the elastic limit of the work piece at normal temperature. In hot bending, the bending work is accomplished by giving a bending moment to the work piece by heating it to a temperature that induces plastic deformation of the work piece. Cold bending is suited for relatively small diameter metal pipes or the like of which no high product precision is required, but it is not suited for relatively large diameter metal pipes or the like of which high product precision is required. Whereas, hot bending is suited for relatively large diameter metal pipes or the like of which high product precision is required, but fairly largescale equipment and a heating apparatus is required. Also, as work efficiency is poor, the working cost is high.

Attempts have been made to overcome these problems. One attempt has been recently developed and put to practical use as an improved method and apparatus for effecting bending work by hot bending. According to this improved method, a metal pipe or the like, to be bent, is first passed through a heating device, such as for example, a high frequency inductor. The high frequency inductor is capable of effecting high temperature heating over a limited area, with the end or a suitable middle part, of said pipe being clamped to an arm which is freely swingable and whose axis of revolution is located within the plane of said heating device. The arm also has a length that matches the bending radius of said pipe. While the pipe is being continuously driven straight forward, it is subjected to local heating to achieve a plastic deformation inducing temperature by said heating device, the heated portion of the pipe being so as to effect continuous plastic deformation in said heated area of said pipe while giving a bending moment to said pipe, thereby to accomplish the desired bending.

Referring first to FIG. 1, there is shown such a conventional bending apparatus. In the figure, reference numeral 1 designates a steel pipe to be bent, 2 a support block adapted to support the pipe end and formed integral with the means for continuously and straightforwardly propelling the steel pipe 1 and a pair of guide rolls 3 and 4, a heating device 5, such as an annular high frequency inductor which is capable of heating a limited area of the steel pipe 1 sidewise to a high temperature, a cooling device 6, integral with said heating device, a rocker arm 7, the pivotal shaft 8, of the arm 7 arranged such that its center resides within the plane of the heating device 5, and a clamp 9 fixed to the arm 7.

In operation of the apparatus just described, steel pipe 1 is first passed between guide rolls 3 and 4 and then further passed through heating device 5 as shown in the drawing. The pipe end is supported by support block 2 of the propelling means, and in certain applications, on end or a suitable middle portion of the steel pipe 1 is fastened to the arm 7 by the clamp 9. The steel pipe 1 is continuously fed straightforwardly by the propelling means while subjected to local heating by heating device 5 to a plastic deformation inducing temperature, and this treatment is immediately followed by cooling so as to effect continuous plastic deformation of the steel pipe 1 in its heated area while giving a bending moment to the pipe by the thrust of the propelling means under the guidance of the arm 7, thereby to accomplish the desired bending. Thus, according to this apparatus, the desired bending of steel pipe can be performed at high efficiency without requiring any elaborate thermal works. The same effect can be obtained by using this apparatus for bending of other types of metal pipes or metal strips. It is to be particularly noted that no bending mold is required and it is possible to bend the pipe at any desired radius of curvature.

According to this method and apparatus, the desired bending can be accomplished on solid metal materials very efficiently with high precision, but when hollow metal pipes are subjected to bending, there takes place in some cases a phenomenon detrimental to the product, such as flattening, flexing or buckling in the pipe, and this may cause a change of curvature increasing or reducing the bending radius of the pipe.

In recent years, pipelines are popularly used for the transportation of fluids, and the number of steel pipes used for such pipelines is increasing at a high rate. Also, more and more high precision is required for bending such pipes.

Thus, demand has been voiced in the industries for development of a method and apparatus which are capable of effecting bending metal pipes such as steel pipes with higher precision than is attainable with the presently available techniques.

In view of the above, the present invention has for its object to provide a method and apparatus which are capable of bending long metal materials such as pipe, bar and rod with high efficiency and high precision.

It is another object of the present invention to provide a method and apparatus which are capable of bending steel pipes used for constructing pipelines for fluid transport without causing any undesirable phenomenon such as flattening, flexing or buckling.

These and other objects and features of the invention will become apparent from the claims and from the following description when read in conjunction with the appended drawings.

THE DRAWINGS

DETAILED DESCRIPTION

Figure 1:
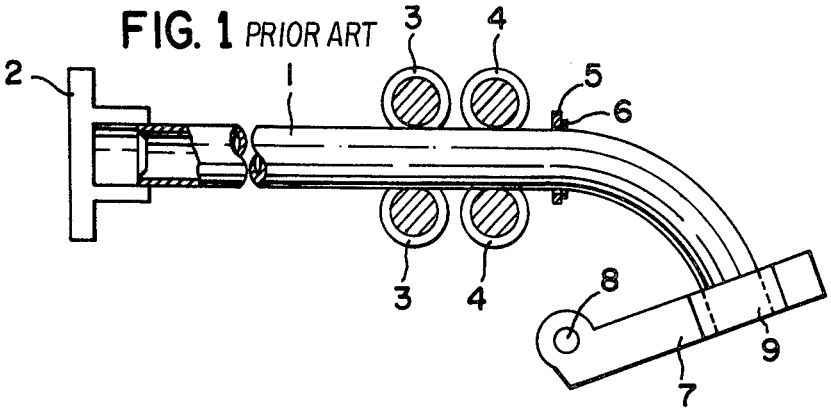
FIG. 1 PRIOR ART
FIG. 1 is a plan view of a conventional apparatus which serves as a basis for the present invention.
Figure 2:
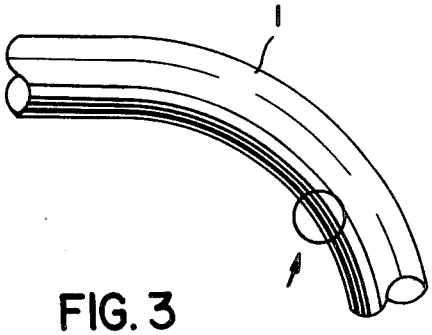
FIG. 2 is a drawing showing the flexing phenomenon which takes place during bending by the apparatus of FIG. 1.
Figure 3:
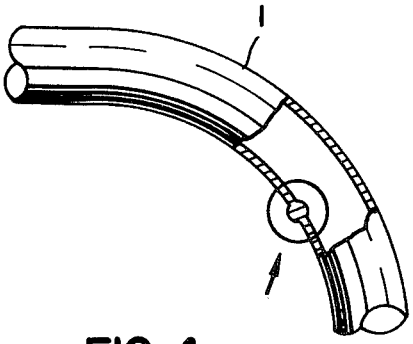
FIG. 3 is a drawing showing the buckling phenomenon which takes place in the same working.

When bending is performed on a metal pipe by using the known apparatus shown in FIG. 1, it is sometimes experienced that deflection or flexure such as shown in FIG. 2 or buckling such as shown in FIG. 3 takes place in the initially bent portion of the pipe. These phenomena are ascribed to the fact that heating of the pipe is started with the pipe being kept in a stationary state in the early phase of bending so that the area to be heated tends to widen and overheat, resulting in sharp variation of distribution of plasticity in the pipe. The smaller the bending radius is, the more pronounced this phenomena becomes.

To prevent these phenomena, the following measures may be taken. The clamp 9 in the apparatus shown in FIG. 1 may be double-structured. A group of clamps may be provided such that the inside clamps holding the metal pipe are slidable relative to the outside clamps engaged to the guide arm. In the early stages of bending, the inside clamps slide a suitable distance within the outside clamps in the pipe feeding direction at a rate lower than the pipe feed rate. In this way, the metal pipe may be held by the extended inside clamps to prevent slippage of the pipe, thereby to enlarge the radius of curvature during the early period of bending to allow smooth bending.

Figure 4:
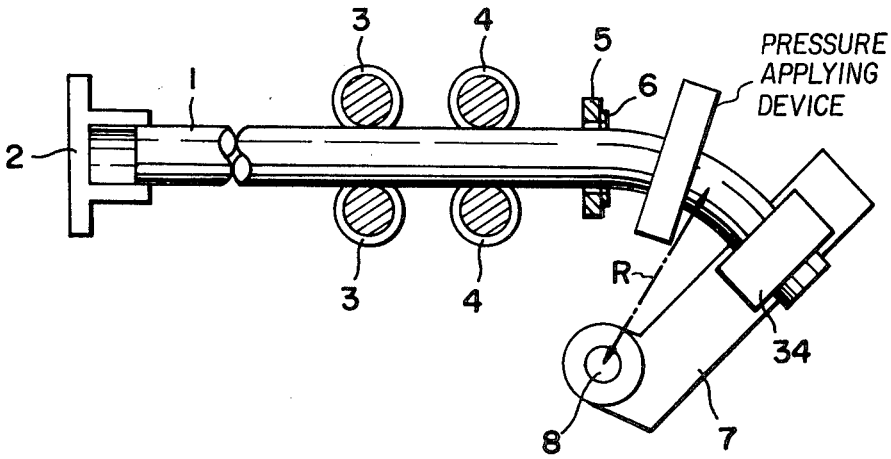
FIG. 4 is a plan view of the apparatus according to the present invention for bending a metal pipe without causing flexing and buckling in the pipe.
Figure 5:
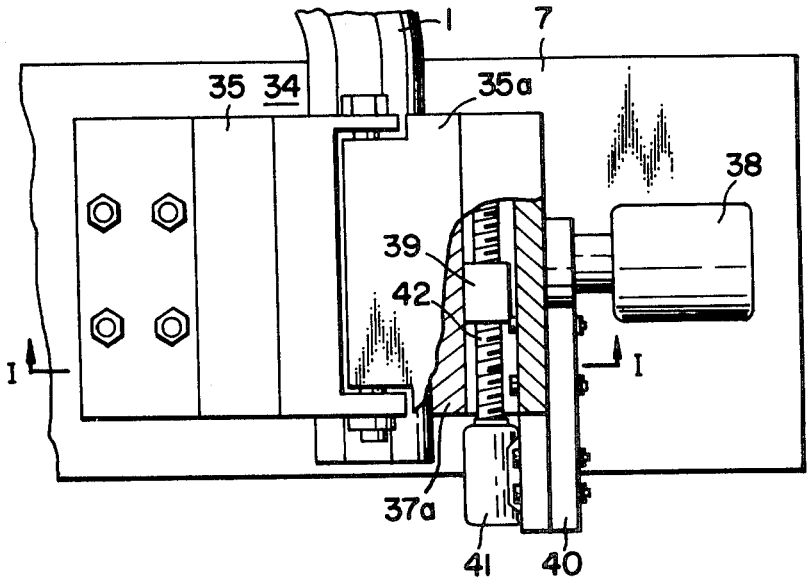
FIG. 5 is a plan view in partial section of the clamp assembly of FIG. 4.
Figure 6:
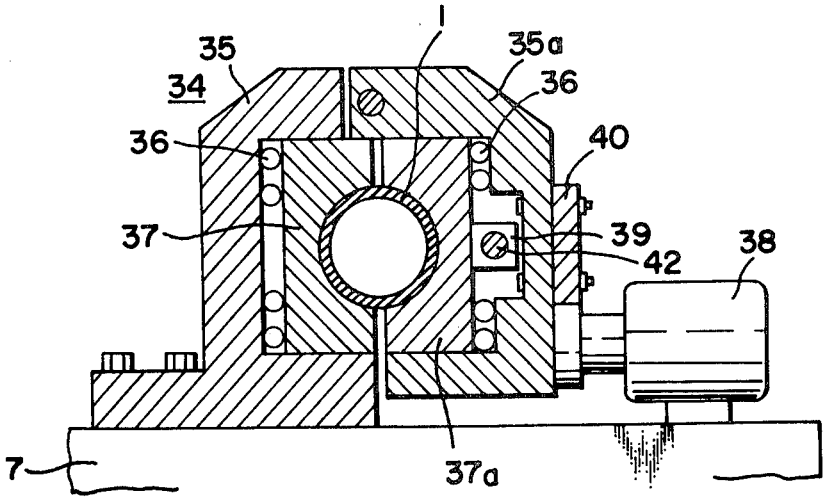
FIG. 6 is a section in elevation taken on the line I—I of FIG. 5.

Shown in FIGS. 4 to 6 is a device which incorporates such means. In the figures, numeral 34 designates a clamp assembly mounted at the end of arm 7 and comprising outside jaws 35, 35*a* which are free to open and close and inside jaws 37, 37*a* slidably mounted in said outside jaws by means of ball bearings 36. The inside jaws comprise a first clamp and the outside jaws comprise a second clamp. The outside jaw 35 is fixed to arm 7, and the leading end of the steel pipe 1 is disposed between inside jaws 37, 37*a* by opening the outside jaw 35*a*. Outside clamp 35*a* is pressed by cylinder 38 mounted on arm 7 to clamp the leading end of the steel pipe 1. A nut 39 is provided integral with the inside jaw 37*a* and a threaded rod 42 secured to the output shaft of the motor 41 is threadedly engaged with said nut 39. A hydraulic motor 41 is connected to the outside jaw 35*a* through a fixing plate 40, so that when the hydraulic motor 41 is driven, the inside jaws 37, 37*a* may be slidably moved relative to the outside jaws 35, 35*a*.

In operation of the device, the steel pipe 1 is passed between guide rolls 3 and 4 and then further passed through the heating device 5 and fastened by clamp means 34 to perform bending as in the apparatus of FIG. 1. In the early phase of bending, the hydraulic motor 41 is driven to let the inside jaws 37, 37*a* slide in the outside jaws 35, 35*a* in the pipe feeding direction at a rate slower than the pipe feed rate while holding the pipe by the inside jaws 37, 37*a*, so as to prevent the steel pipe from being deflected or buckled by the influence of sharp stress. It will be readily understood from the figures that the inside clamp may move in directions parallel to the principal axis of the clamped portion of the pipe, i.e., in directions generally perpendicular to the plane of FIG. 6, and generally tangential to an arc through which the clamp assembly 34 is moved. After the inside jaws 37, 37*a* have slidingly moved a sufficient distance, the hydraulic motor 41 is stopped and the steel pipe 1 is clamped by the entirety of the clamp means 34 to effectuate bending of the pipe 1 in the same manner as the apparatus of FIG. 1. The rate at which inside jaws 37, 37*a* are moved in the pipe feeding direction in the early stage of bending is selected to be slower than the pipe feed rate, usually about ½ of the pipe feed rate. The distance of sliding movement of the inside jaws 37, 37*a*, although varied depending on the size of steel pipe 1 and its bending radius, is usually from about 20 to about 25 mm. Additionally, where hollow material is to be bent, means may be provided to apply pressure to the material from a direction perpendicular to the crushing force on the material which tends to flatten the material as it is bent. Such a pressure applying device is shown in FIG. 4. The pressure applied by the device to the pipe is generally perpendicular to the plane of FIG. 4.

In this way, flexure and buckling of the pipe during bending may be eliminated.

The principles, preferred embodiments and modes of operation of the present invention have been described in the foregoing specification. The invention which is intended to be protected is not, however, to be construed as limited to the particular forms desclosed, since these are to be regarded as illustrative rather than restrictive. Variations and changes may be made by those skilled in the art without departing from the spirit and scope of the present invention.

I claim:

1. An apparatus for hot bending elongated materials such as pipe comprising:

means for advancing the elongated material;

means for guiding an unbent portion of the material;

annular heating means for heating a limited region of the material to a high temperature;

a bending arm freely pivotable about an axis located in the plane of the heating means; and, means on said bending arm for clamping a leading portion of the material including a first clamp, contacting the material, and slidably moveable with respect to the arm in a direction generally parallel to the longitudinal axis of the clamped portion of the material.

2. The apparatus of claim 1 further comprising means for sliding said first clamp in the direction of advance of the elongated material at a speed less than the speed of the advance of the elongated material.

3. The apparatus of claim 2 wherein said means for engaging the material includes:

a second outer clamp attached to the bending arm;

a plurality of ball bearings disposed between the outer clamp and the first clamp whereby, the first clamp is slidable within the second outer clamp; and, means for compressing the second outer clamp to thereby cause the first clamp to close on the material to engage the material.

4. In a process for hot bending elongated material comprising the steps of passing the material through a heating device, engaging a clamp to a leading portion of the pipe, said clamp being carried by a pivotable arm, and advancing the pipe while heating the material locally to a plastic deformation inducing temperature, thereby applying a bending moment to the material to cause continuous plastic deformation in the heated area of the pipe, the improvement comprising the step of moving the clamp with respect to the arm in a direction generally tangential to an arc through which the arm is pivoted during the bending of the material.

5. The improvement of claim 4 wherein the clamp is driven to move in the direction of the advance of the material at a speed less than the speed of the advance of the material.

6. An apparatus for hot bending metal materials such as circular metal pipes, of circular cross section, comprising:

(a) means for continuously advancing a metal material to be bent;

(b) means for guiding an unbent portion of the metal material;

(c) annular heating means for heating a limited area of the material to a high temperature;

(d) cooling means for cooling the strip immediately after the heating thereof;

(e) an arm which is freely pivotable about an axis located within the plane of said heating means, said arm carrying means for clamping a portion of the metal material to guide the material in its bending direction, said clamping means comprising inside clamps adapted to hold the material to be worked therebetween and outside clamps through which said inside clamps are slidable; and (f) means for applying pressure to the material from a direction generally perpendicular to the plane of the bend at a suitable location adjacent said cooling means.

* * * * *